US005088458A

United States Patent [19]

Wakeman et al.

[11] Patent Number: 5,088,458

[45] Date of Patent: Feb. 18, 1992

[54] LASH ADJUSTED FOR ENGINE VALVE ACTUATOR ASSEMBLY

[75] Inventors: Russell J. Wakeman; Stephen F. Shea, both of Newport News, Va.

[73] Assignee: Siemens Automotive L.P., Auburn Hills, Mich.

[21] Appl. No.: 649,643

[22] Filed: Feb. 1, 1991

[51] Int. Cl.[5] ..... F01L 1/24

[52] U.S. Cl. ..... 123/90.55; 123/90.49

[58] Field of Search ..... 123/90.12, 90.48, 90.49, 123/90.52, 90.55, 90.56, 90.57

[56] References Cited

U.S. PATENT DOCUMENTS

| | | | |
|---|---|---|---|
| 3,921,609 | 11/1975 | Rhoads | 123/90.55 |
| 4,164,917 | 8/1979 | Glasson | 123/90.55 |
| 4,463,714 | 8/1984 | Nakamura | 123/90.57 |
| 4,530,320 | 7/1985 | Ferrero | 123/90.56 |
| 4,796,573 | 1/1989 | Wakeman et al. | 123/90.16 |
| 4,867,113 | 9/1989 | Pieprzak et al. | 123/90.49 |
| 4,881,499 | 11/1989 | Dietrich et al. | 123/90.52 |
| 4,917,059 | 4/1990 | Umeda | 123/90.55 |
| 4,941,438 | 7/1990 | Muto | 123/90.55 |

*Primary Examiner*—E. Rollins Cross

*Assistant Examiner*—Weilun Lo

*Attorney, Agent, or Firm*—George L. Boller; Russel C. Wells

[57] ABSTRACT

A valve damping piston and a cam follower piston have telescopic sliding fits in opposite ends of a through-bore in the lifter housing. A pressure chamber is cooperatively defined within the housing between the two pistons, and is communicated to the engine oil supply. A lash adjusting piston has a telescopical sliding fit with the exterior axial end of the damping piston, and the two cooperatively define between themselves a lash adjusting chamber. The lash adjusting chamber is communicated to the pressure chamber by an axial segment of the telescopic sliding fit of the damping piston to the housing. The clearance provided by this axial segment creates a flow restriction that results in the pressure in the lash adjusting chamber being appreciably lower, 50% for example, than the pressure in the pressure chamber. The damping piston contains a circumferential groove that is directly communicated to the termination of the axial segment. A radial and then an axial hole in the damper piston communicate the groove to the lash adjusting chamber.

12 Claims, 1 Drawing Sheet

LASH ADJUSTED FOR ENGINE VALVE ACTUATOR ASSEMBLY00

FIELD OF THE INVENTION

This invention relates generally to internal combustion engines, and more particularly to a hydraulic valve lifter, including a lash adjuster, for such an engine.

BACKGROUND AND SUMMARY OF THE INVENTION

In the present applicants' U.S. Pat. No. 4,796,573 dated Jan. 10, 1989, the hydraulic valve lifter includes a lash adjustment mechanism in which a lash adjusting piston defines cooperatively with a valve damping piston, a lash adjusting chamber that is communicated through a check valve carried by the latter piston directly to a pressure chamber which is cooperatively defined by the valve damping piston and a cam follower piston and which is supplied with pressurized hydraulic fluid in the form of oil from the engine's oil system. Further development work on the lash adjusting mechanism has revealed that the magnitude of oil pressure that acts on it can influence its performance. Specifically, it has been found that a reduction in the oil pressure magnitude acting on the lash adjusting mechanism can improve the lash adjustment function. The problem is therefore posed as to how to create such a pressure reduction with minimum revision of existing hardware and/or addition of new hardware, and without attenuating hydraulic pressures in locations where such attenuated pressures would be unacceptable.

The present invention provides an ingenious solution to this problem. Pressure attenuation is achieved only for the hydraulic fluid supplied to the lash adjusting mechanism so that hydraulic pressures at other locations do not have to be attenuated.

The hydraulic pressure attenuation at the lash adjusting mechanism is accomplished by modifying the hydraulic fluid communication path between the aforementioned pressure chamber and lash adjusting chamber to include a restriction that is formed by the sliding clearance between the lash adjusting piston and the valve damping piston. A circular annular groove extends around the outside of the damping piston and is in direct communication with the termination of the sliding clearance restriction. A slant hole extends radially inwardly from the circular annular groove and ends at an intersection with a central axial blind hole that is open to the lash adjusting chamber. The sliding clearance restriction creates a pressure drop such that the pressure of hydraulic fluid in the circular annular groove is significantly less than the hydraulic pressure in the pressure chamber, and this reduced pressure is delivered through the slant and axial holes in the damping piston, which themselves may supply some small, but relatively insignificant, additional pressure drop.

The relative dimensions of the O.D. of the lash adjusting piston and the I.D. of the valve damping piston can be controlled accurately enough by conventional manufacturing processes such that a desired pressure attenuation in the sliding clearance restriction results. The circular annular groove provides a suitable surface with which a drill bit of sufficient strength can be engaged for drilling the slant hole. Thus, the invention enables the pressure reduction for the lash adjusting piston to be embodied in the lifter solely by conventional machining operations and without any additional parts beyond those of the lifter of U.S. Pat. No. 4,796,573.

The foregoing, as well as additional, features, advantages, and benefits of the invention, will be seen in the ensuing disclosure which includes a drawing of the best mode contemplated at the present time in carrying out the invention.

DESCRIPTION OF THE PREFERRED EMBODIMENT

Figure 2:
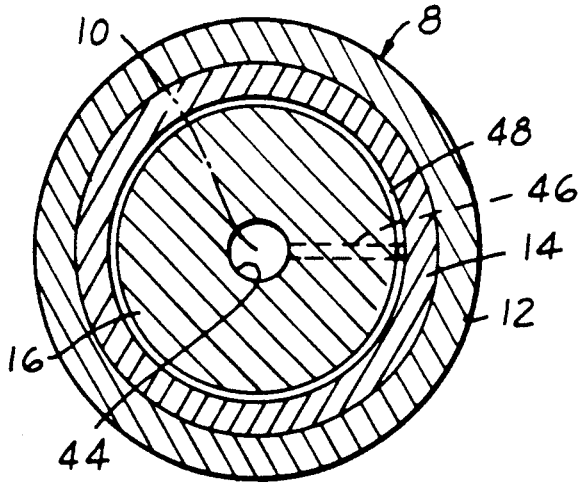
FIG. 2 is a transverse cross section taken in the direction of arrows 2—2 in FIG. 1.

The drawing illustrates an exemplary embodiment of lifter assembly 8 embodying the inventive principles and having a main longitudinal axis 10. Lifter assembly 8 comprises housing means consisting of generally tubular shaped parts 12 and 14 fitted together as shown so that the housing means comprises a through-bore that is coaxial with axis 10. A valve damping piston 16 has a telescopic sliding fit in one end of this through-bore, and a cam follower piston 18 has a telescopic sliding fit in the opposite end. A pressure chamber 20 is cooperatively defined between the two pistons 16 and 18 and is communicated to a supply of pressurized hydraulic fluid (not shown) via a radial hole 22 through the side wall of part 12. The non-illustrated supply of pressurized hydraulic fluid is like that shown in U.S. Pat. No. 4,796,573. Disposed within pressure chamber 20 is a damping means which comprises a by-pass ring 24 and a check ring 26. These component parts perform a damping function in analogous manner to the damping function performed by corresponding component parts in U.S. Pat. No. 4,796,573. A spring 28 is also included in the present embodiment although no such spring is illustrated in the drawings of U.S. Pat. No. 4,796,573. The present embodiment comprises a helical coil spring 30 disposed to act between piston 18 and ring 24.

A lash adjusting piston 32 is telescopically fitted to the external end of piston 16, and the two are designed to cooperatively define between themselves a lash adjusting chamber 34 which contains a helical coil spring 36 acting to urge the two toward separation. A spherical check valve element 38 is captured on piston 16 by means of a perforated retainer 40. A helical coil spring 42 acts between an end of retainer 40 and element 38 to urge the latter toward closure of the open end of a blind hole 44 that has been provided in piston 16 coaxial with axis 10. A slant hole 46 extends from hole 44 both radially outwardly of the latter hole and axially away from piston 18 to a circular annular groove 48 that has been provided around the outside of piston 16.

Groove 48 is in fluid communication with pressure chamber 20 via an axial segment 50 of the close sliding telescopic fit of piston 16 within the housing means's central through-bore. This segment of the close sliding fit provides a restriction that is effective to create a pressure drop between the pressure of the hydraulic fluid in pressure chamber 20 and the pressure of the hydraulic fluid in groove 48 so that the fluid that is introduced into lash adjusting chamber 34 has a significantly lower pressure than the fluid in pressure chamber 20. There may be some additional pressure drop through holes 46 and 44, but in general this will be fairly insignificant in comparison to the pressure drop across segment 50. The pressure attenuation results in a lower pressure of hydraulic fluid going into lash adjusting chamber 34 than would be the case for the lash adjuster shown in U.S. Pat. No. 4,796,573. In all other respects the association of lifter assembly 8 with the engine is the same as that described in U.S. Pat. No. 4,796,573, and the two lifter assemblies function in analogous fashion even though the respective embodiments may differ in certain details.

Figure 1:
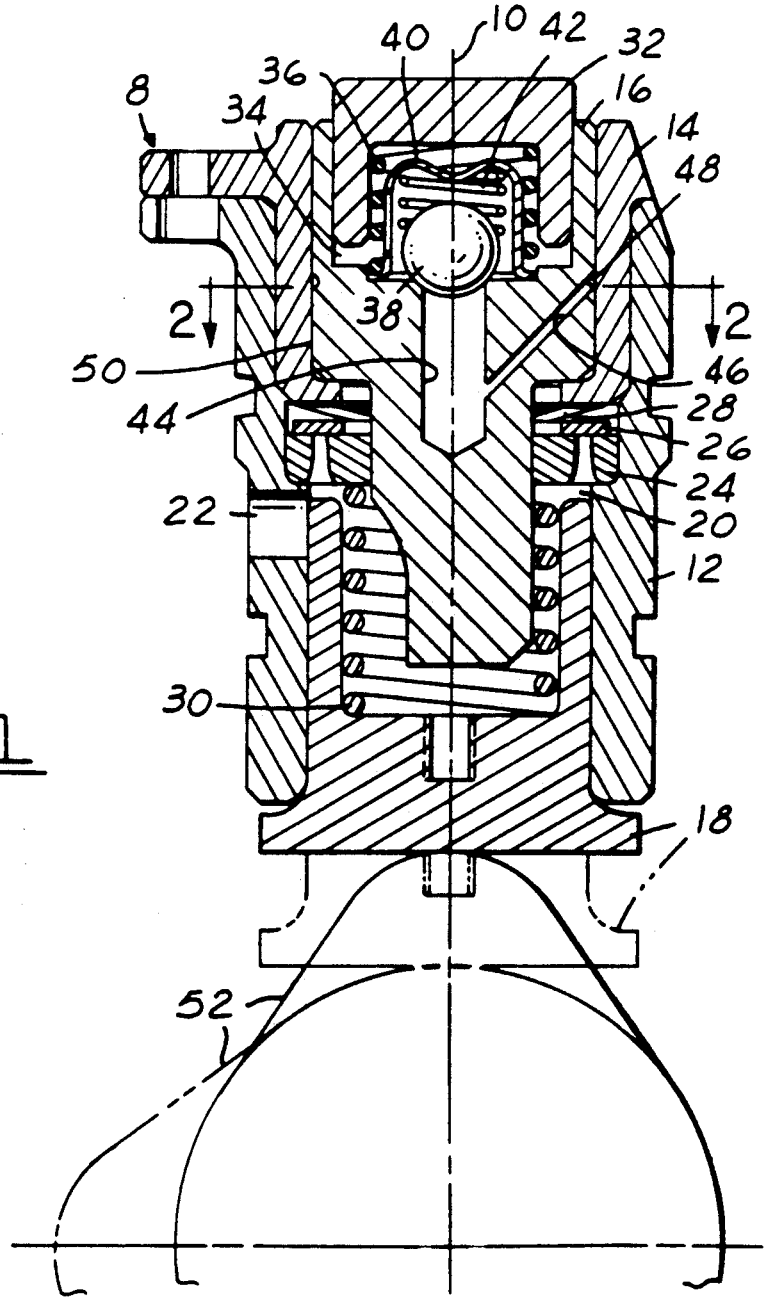
FIG. 1 is a longitudinal cross section through a lifter assembly embodying principles of the invention, showing one particular operating position.

The exterior end face of piston 18 rides on the corresponding cam 52 of the engine camshaft and the exterior end face of piston 32 rides against the rounded surface at one end of the corresponding rocker arm. Since lifter assembly 8 is intended to be used in a variable valve timing system, the relative size of pressure chamber 20 will depend upon the particular valve timing that is occuring at any given time. The illustrated operating position of lifter assembly 8 in FIG. 1 is for a condition of minimum volume of pressure chamber 20, and the corresponding engine valve being at the midpoint of whatever its stroke, if any for this particular volume of pressure chamber 20, may happen to be.

While a preferred embodiment of the invention has been illustrated and described, it should be appreciated that the inventive principles may be practiced in any way that is equivalent to the following claims.

What is claimed is:

1. In a hydraulic engine valve lifter which comprises housing means comprising through-bore structure that is closed at each respective end by the telescopic sliding fit engagement with said housing means of a respective one of two pistons which are hydraulically coupled via a pressure chamber means which is cooperatively defined by said pistons within said housing means, which is supplied with pressurized hydraulic fluid, and which contains means to impart a certain damping characteristic to at least one of said two pistons at least at times during operation of the lifter and a lash adjusting piston which is telescopically arranged on one of said first two pistons for cooperation therewith in defining a lash adjusting chamber that is hydraulically communicated with said pressure chamber means via a communication path which includes a check-valve means that allows hydraulic fluid to pass from said pressure chamber means to said lash adjusting chamber but not vice versa, the improvement which comprises said communication path comprising a restriction that is cooperatively defined by a portion of the telescopic fit between said one of said first two pistons and said housing means to provide a pressure drop in the flow of hydraulic fluid from said pressure chamber means to said lash adjusting chamber.

2. The improvement set forth in claim 1 in which the telescopic sliding fit engagement of said one of said first two pistons with said housing means is with said through-bore structure and said restriction is cooperatively defined by an axial segment of the telescopic sliding fit engagement of said one of said first two pistons with said through-bore structure.

3. The improvement set forth in claim 2 in which said one of said first two pistons comprises a groove in a side wall portion thereof, said groove being in direct fluid communication with the termination of said restriction.

4. The improvement set forth in claim 3 in which said groove is a circumferentially continuous annular groove extending around said side wall portion of said one of said first two pistons.

5. The improvement set forth in claim 4 in which said communication path comprises a radial hole in said one of said first two pistons that extends radially inwardly from said groove.

6. The improvement set forth in claim 5 in which said radial hole intersects a central axial blind hole in said one of said first two pistons, said central axial blind hole forming a continuation of said communication path that continues from said radial hole.

7. The improvement set forth in claim 6 in which said radial hole is arranged at an acute angle to an axis along which said one of said first two pistons has a sliding fit engagement with said through-bore.

8. The improvement set forth in claim 7 in which said radial hole, while extending radially inwardly, also extends axially toward the other of said first two pistons.

9. In a hydraulic engine valve lifter which comprises housing means with which a first piston has a telescopic sliding fit engagement and a second piston which has a telescopic sliding fit engagement with said first piston for cooperation therewith in defining a chamber that is hydraulically communicated with a supply of pressure fluid via a communication path that allows hydraulic fluid to pass from said supply to said chamber, the improvement which comprises said communication path comprising a restriction that is cooperatively defined by a portion of the telescopic fit between said first piston and said housing means to provide a pressure drop in the flow of hydraulic fluid from said supply to said chamber, the telescopic sliding fit engagement of said first piston with said housing means is with a bore in said housing means, said restriction is cooperatively defined by an axial segment of the telescopic sliding fit engagement of said first piston with said bore, said first piston comprises a groove in a side wall portion thereof, said groove being in direct fluid communication with the termination of said restriction, said groove is a circumferentially continuous annular groove extending around said side wall portion of said first piston, said communication path comprises a radial hole in said first piston that extends radially inwardly from said groove, and said radial hole intersects a central axial blind hole in said first piston, said central axial blind hole forming a continuation of said communication path that continues from said radial hole.

10. The improvement set forth in claim 9 in which said radial hole is arranged at an acute angle to an axis along which said first piston has a sliding fit engagement with said bore.

11. The improvement set forth in claim 9 in which said radial hole, while extending radially inwardly, also extends axially away from said second piston.

12. In a hydraulic lash adjuster for an engine valve lifter which comprises housing means with which a member has a telescopic fit engagement and a lash adjusting piston which has a telescopic sliding fit engagement with said member for cooperation therewith in defining a chamber that is hydraulically communicated with a supply of pressure fluid via a communication path that allows hydraulic fluid to pass from said supply to said chamber, the improvement which comprises said communication path comprising a restriction that is cooperatively defined by a portion of the telescopic fit between said member and said housing means to provide a pressure drop in the flow of hydraulic fluid from said supply to said chamber, the telescopic fit engagement of said member with said housing means is with a bore in said housing means, and said restriction is so operatively defined by an axial segment of the telescopic fit engagement of said member with said bore, said member comprises a groove in a side wall portion thereof, said groove being in direct fluid communication with the termination of said restriction, said groove is a circumferentially continuous annular groove extending around said side wall portion, and said communication path comprises a radial hole in said member that extends radially inwardly from said groove and intersects a central axis blind hole in said member, said central axial blind hole forming a continuation of said communication path that continues from said radial hole.

* * * * *